US007582203B2

(12) United States Patent
Mo et al.

(10) Patent No.: US 7,582,203 B2
(45) Date of Patent: Sep. 1, 2009

(54) HYDROCARBON CRACKING PROCESS FOR CONVERTING GAS OIL PREFERENTIALLY TO MIDDLE DISTILLATE AND LOWER OLEFINS

(75) Inventors: Weijian Mo, Sugar Land, TX (US); Georghios Agamemnonons Hadjigeorge, Sugar Land, TX (US); Frank Hsian Hok Khouw, Voorburg (NL)

(73) Assignee: Shell Oil Company, Houston, TX (US)

( * ) Notice: Subject to any disclaimer, the term of this patent is extended or adjusted under 35 U.S.C. 154(b) by 262 days.

(21) Appl. No.: 11/332,980

(22) Filed: Jan. 17, 2006

(65) Prior Publication Data

US 2006/0191820 A1 Aug. 31, 2006

Related U.S. Application Data

(63) Continuation-in-part of application No. 11/199,050, filed on Aug. 8, 2005.

(60) Provisional application No. 60/600,264, filed on Aug. 10, 2004.

(51) Int. Cl.
*C10G 11/04* (2006.01)

(52) U.S. Cl. ..... 208/120.1; 208/113; 502/61; 502/67; 502/71; 502/77

(58) Field of Classification Search ..... 208/113, 208/120.1; 502/61, 67, 71, 77
See application file for complete search history.

(56) References Cited

U.S. PATENT DOCUMENTS

| | | | | |
|---|---|---|---|---|
| 3,130,007 | A | 4/1964 | Breck | 23/113 |
| 3,702,886 | A | 11/1972 | Argauer et al. | 423/328 |
| 3,709,979 | A | 1/1973 | Woodbury | 423/328 |
| 3,770,614 | A | 11/1973 | Graven | 208/62 |
| 3,832,449 | A | 8/1974 | Rosinski et al. | 423/328 |
| 3,928,172 | A | 12/1975 | Davis, Jr. et al. | 208/77 |
| 3,948,758 | A | 4/1976 | Bonacci et al. | 208/92 |
| 4,016,245 | A | 4/1977 | Plank et al. | 423/328 |
| 4,051,013 | A | 9/1977 | Strother | 208/78 |
| 4,076,842 | A | 2/1978 | Plank et al. | 423/328 |
| 4,111,793 | A | 9/1978 | Kolombos et al. | 208/121 |
| 4,254,297 | A | 3/1981 | Frenken et al. | 585/640 |
| 4,309,280 | A | 1/1982 | Rosinski et al. | 208/120 |

(Continued)

FOREIGN PATENT DOCUMENTS

| | | |
|---|---|---|
| EP | 229295 | 7/1987 |

(Continued)

OTHER PUBLICATIONS

International Search Report for PCT/US2005/028053 of Nov. 7, 2005.

(Continued)

*Primary Examiner*—Glenn Caldarola
*Assistant Examiner*—Prem C. Singh
(74) *Attorney, Agent, or Firm*—William E. Hickman

(57) ABSTRACT

Described is a hydrocarbon cracking process for converting a heavy hydrocarbon feedstock selectively to middle distillate and lower olefins by catalytically cracking a heavy hydrocarbon feedstock within a riser reactor zone by contacting the heavy hydrocarbon feedstock with both a middle distillate selective cracking catalyst in combination with a shape selective zeolite additive under suitable catalytic cracking reaction conditions.

7 Claims, 5 Drawing Sheets

U.S. PATENT DOCUMENTS

| | | | | |
|---|---|---|---|---|
| 4,310,440 | A | 1/1982 | Wilson et al. | 252/435 |
| 4,368,114 | A | 1/1983 | Chester et al. | 208/120 |
| 4,440,871 | A | 4/1984 | Lok et al. | 502/214 |
| 4,500,651 | A | 2/1985 | Lok et al. | 502/208 |
| 4,711,710 | A | 12/1987 | Chen et al. | 208/111 |
| 4,731,174 | A | 3/1988 | Occelli et al. | 208/120 |
| 4,803,186 | A | 2/1989 | Chen et al. | 502/66 |
| 4,830,728 | A | 5/1989 | Herbst et al. | 208/78 |
| 4,927,523 | A | 5/1990 | Donnelly | 208/120 |
| 4,929,337 | A | 5/1990 | Herbst et al. | 208/120 |
| 4,994,173 | A | 2/1991 | Tai-Sheng et al. | 208/152 |
| 5,000,837 | A | 3/1991 | Harandi | 208/67 |
| 5,009,769 | A | 4/1991 | Goelzer | 208/113 |
| 5,055,437 | A * | 10/1991 | Herbst et al. | 502/67 |
| 5,156,817 | A | 10/1992 | Luckenbach | 422/144 |
| 5,168,086 | A | 12/1992 | Cheng et al. | 502/66 |
| 5,234,575 | A | 8/1993 | Haag et al. | 208/710 |
| 5,234,578 | A | 8/1993 | Stine et al. | 208/113 |
| 5,318,696 | A | 6/1994 | Kowalski | 208/120 |
| 5,372,704 | A | 12/1994 | Harandi et al. | 208/74 |
| 5,435,906 | A | 7/1995 | Johnson et al. | 208/78 |
| 5,451,313 | A | 9/1995 | Wegerer et al. | 208/164 |
| 5,547,564 | A | 8/1996 | Cheng et al. | 208/122 |
| 5,565,176 | A | 10/1996 | Johnson et al. | 422/1.44 |
| 5,730,859 | A | 3/1998 | Johnson et al. | 208/78 |
| 5,888,378 | A | 3/1999 | Kowalski | 208/114 |
| 5,944,982 | A | 8/1999 | Lomas | 208/164 |
| 5,965,012 | A | 10/1999 | Lomas | 208/113 |
| 6,106,697 | A | 8/2000 | Swan et al. | 208/77 |
| 6,123,832 | A | 9/2000 | Ho et al. | 208/113 |
| 6,166,282 | A | 12/2000 | Miller | 585/638 |
| 6,258,257 | B1 | 7/2001 | Swan, III et al. | 208/74 |
| 6,287,522 | B1 | 9/2001 | Lomas | 422/144 |
| 6,455,750 | B1 | 9/2002 | Steffens et al. | 585/648 |
| 6,538,169 | B1 | 3/2003 | Pittman et al. | 585/653 |
| 6,656,344 | B1 | 12/2003 | Rao et al. | 208/113 |
| 6,723,227 | B1 | 4/2004 | Samson | 208/113 |
| 6,791,002 | B1 | 9/2004 | Abrevaya et al. | 585/648 |
| 6,835,302 | B2 | 12/2004 | Cammy et al. | 208/113 |
| 6,866,771 | B2 | 3/2005 | Lomas et al. | 208/74 |
| 7,029,571 | B1 | 4/2006 | Bhattacharyya et al. | 208/76 |
| 7,033,546 | B2 | 4/2006 | Lomas | 422/145 |
| 7,041,259 | B2 | 5/2006 | Cammy et al. | 422/145 |
| 7,083,762 | B2 | 8/2006 | Kuechler et al. | 422/144 |
| 7,102,050 | B1 | 9/2006 | Lattner et al. | 585/640 |
| 7,112,307 | B2 | 9/2006 | Abrevaya et al. | 422/142 |
| 7,122,160 | B2 | 10/2006 | Brookhart | 422/145 |
| 7,169,293 | B2 | 1/2007 | Lomas et al. | 208/146 |
| 7,195,741 | B2 | 3/2007 | Lattner et al. | 422/141 |
| 7,261,807 | B2 | 8/2007 | Henry et al. | 208/113 |
| 7,312,370 | B2 | 12/2007 | Pittman et al. | 585/648 |
| 2002/0003103 | A1 | 1/2002 | Henry et al. | 208/106 |
| 2003/0116471 | A1 | 6/2003 | Zhang et al. | 208/113 |
| 2003/0121825 | A1 * | 7/2003 | Pittman et al. | 208/113 |
| 2005/0074371 | A1 | 4/2005 | Lomas et al. | 422/144 |
| 2005/0118076 | A1 | 6/2005 | Lomas | 422/139 |
| 2006/0076269 | A1 | 4/2006 | Lomas | 208/113 |
| 2006/0113217 | A1 | 6/2006 | Andreux | 208/113 |
| 2006/0229483 | A1 | 10/2006 | Kuechler et al. | 585/639 |
| 2006/0283777 | A1 | 12/2006 | Alvarenga Baptista et al. | 208/120.1 |
| 2007/0007176 | A1 | 1/2007 | Pinho et al. | 208/108 |
| 2007/0122316 | A1 | 5/2007 | Lomas et al. | 422/145 |

FOREIGN PATENT DOCUMENTS

| | | |
|---|---|---|
| EP | 305720 | 7/1988 |
| EP | 325437 | 7/1989 |
| EP | 168979 | 8/1989 |
| EP | 490435 | 4/1991 |
| EP | 814144 | 12/1997 |
| EP | 834540 | 4/1998 |
| EP | 867497 | 9/1998 |
| EP | 909582 | 4/1999 |
| EP | 968256 | 1/2000 |
| EP | 1146107 | 10/2001 |
| WO | 00/31215 | 6/2000 |
| WO | 03/054115 | 7/2003 |

OTHER PUBLICATIONS

Written Opinion for PCT/us2005/028053 of Nov. 7, 2005.

J. Catalysis. 67. 218-222.

"Atlas of Zeolite Structure Types." Eds. W. H. Meier and D.H. Oson. Butterworth-Heineman. Third Edition 1992.

Jean Seydoux et al, "A Deep Resistivity Logging-While-Drilling Device for Proactive Geosteering", The Leading Edge, Jun. 2004, pp. 581-586.

* cited by examiner

HYDROCARBON CRACKING PROCESS FOR CONVERTING GAS OIL PREFERENTIALLY TO MIDDLE DISTILLATE AND LOWER OLEFINS

This application is a continuation-in-part of U.S. application Ser. No. 11/199,050, filed Aug. 8, 2005, now pending and which claims the benefit of U.S. Provisional Application Ser. No. 60/600,264, filed Aug. 10, 2004.

The invention relates to a process for the cracking of gas oil to preferentially yield middle distillate and lower olefins.

The fluidized catalytic cracking (FCC) of heavy hydrocarbons to produce lower boiling hydrocarbon products such as gasoline is well known in the art. FCC processes have been around since the 1940's. Typically, an FCC unit or process includes a riser reactor, a catalyst separator and stripper, and a regenerator. An FCC feedstock is introduced into the riser reactor wherein it is contacted with hot FCC catalyst from the regenerator. The mixture of the feedstock and FCC catalyst passes through the riser reactor and into the catalyst separator wherein the cracked product is separated from the FCC catalyst. The separated cracked product passes from the catalyst separator to a downstream separation system and the separated catalyst passes to the regenerator where the coke deposited on the FCC catalyst during the cracking reaction is burned off the catalyst to provide a regenerated catalyst. The resulting regenerated catalyst is used as the aforementioned hot FCC catalyst and is mixed with the FCC feedstock that is introduced into the riser reactor.

The prior art discloses the use in FCC units of shape selective zeolites such as ZSM-5 in combination with conventional catalytic cracking catalysts to provide for enhancements in the yield or in the octane of the cracked gasoline product. For instance, U.S. Pat. No. 4,927,523 describes a method of adding an additive zeolite to a catalytic cracking unit along with its equilibrium catalytic cracking catalyst to be contacted with a heavy feed to produce cracked products that include gasoline. The patent is focused on providing for the enhancement of the gasoline product octane number and discloses that the cracking catalyst typically comprises a large pore zeolite in an amorphous matrix. There is no indication that the process disclosed in U.S. Pat. No. 4,927,523 provides for the preferential manufacture of middle distillate, and it indicates that an increase in the production of $C_3/C_4$ olefins can be unacceptable. In fact, the claimed method requires the adjustment of the cracking unit operation in order to reduce the increase in production of $C_3/C_4$ olefins resulting from the addition of zeolite additive to the equilibrium catalyst of the cracking unit. This patent clearly fails to mention the use of middle distillate selective catalyst in combination with a shape selective zeolite additive in a cracking unit for the purpose of preferentially yielding lower olefins and middle distillate products as opposed to gasoline product.

U.S. Pat. No. 4,929,337 discloses a multi-component catalytic cracking catalyst mixture that is tolerant to the effects of the deposition of metals, such a nickel and vanadium, on the catalyst mixture. The catalyst mixture includes a bulk conversion cracking catalyst, at least one shape selective zeolite component having paraffin cracking/isomerization activity, and at least one shape selective zeolite component having paraffin aromatization activity. The bulk conversion cracking catalyst comprises a large pore cracking component such as large pore and very large pore molecular sieves having pore sizes of about 7 angstroms in diameter or greater. This patent does not mention the use of middle distillate selective catalyst in combination with a shape selective zeolite additive in a cracking unit for the purpose of preferentially yielding lower olefins and middle distillate products. Instead, it indicates that one of the important concerns of its invention is to provide for the control of the amount of so-called "top of the barrel" conversion and for the control and optimization of the yield and properties of the gasoline product. The patent further indicates that its invention provides for certain of the aforementioned benefits over those provided by the use of a conventional cracking catalyst in combination with 2 wt. % ZSM-5. A conventional cracking catalyst is indicated as being a large pore zeolite in a matrix.

U.S. Pat. No. 4,994,173 discloses a method of adding ZSM-5 catalyst to a conventional catalytic cracking equilibrium catalyst of a catalytic cracking unit to provide for an improvement in the gasoline product octane without significant loss in gasoline plus distillate yield. The ZSM-5 is preferably selectivated. Conventional cracking catalysts are indicated as being crystalline molecular sieves having such acid activity to catalyze the cracking of heavy hydrocarbons and that are relatively large pore zeolites in a matrix such as clay. The focus of this patent is on the manufacture of gasoline product and on the improvement in its octane. The patent is not concerned with the operation of a catalytic cracking unit to selectively yield a middle distillate product and lower olefins, and there is no mention of the use of a middle distillate selective catalyst in combination with a shape selective zeolite additive in a cracking unit to provide for such selective yields.

U.S. Pat. No. 5,318,696 discloses a catalytic cracking process that uses a catalyst comprising conventional large-pore molecular sieve material and specially synthesized ZSM-5 crystal as an additive. The use of the improved additive catalyst results in an enhancement of the octane of the gasoline product of a cracking process and its propylene yield. The process of the patent is not directed to the production of middle distillate, and there is no mention in the patent of the combined use of a middle distillate selective cracking catalyst with a shape selective zeolite additive in a cracking process to preferentially produce middle distillate product and lower olefins.

The aforedescribed prior art teaches the catalytic cracking of heavy hydrocarbon feedstocks primarily for the purpose of making high-octane gasoline. Much of the described efforts are directed toward the improvement in the quality properties, such as octane, and the yield of the gasoline product resulting from the catalytic cracking of a heavy hydrocarbon feedstock. None of the cited prior art references indicated a preference toward the yielding from a catalytic cracking unit of middle distillate product. It can, however, depending on market conditions, be desirable for a heavy hydrocarbon catalytic cracking unit to preferentially yield both middle distillate product, such as diesel or fuel oil, and lower olefins, such as propylene and butylenes. It is difficult to achieve high yields of both middle distillate and lower olefins due to the higher activity catalysts and high severity reactor conditions required in order to provide for increases in lower olefins yield but which result in reduced yields of middle distillate. Lower severity reactor conditions and less active cracking catalysts are usually required for improved yields of middle distillate product.

It is, thus, an object of the invention to provide an improved catalytic cracking process that provides for the enhanced and selective production of both middle distillate and lower olefins in the cracking of a heavy hydrocarbon feedstock.

Accordingly, provided is a hydrocarbon cracking process for converting a heavy hydrocarbon feedstock preferentially to middle distillate and lower olefins, wherein said hydrocarbon cracking process comprises: catalytically cracking said heavy hydrocarbon feedstock within a riser reactor zone by contacting under suitable catalytic cracking conditions within said riser reactor zone said heavy hydrocarbon feedstock with a middle distillate selective cracking catalyst in combination with a shape selective zeolite additive that are introduced into said riser reactor zone, wherein said middle distillate selective cracking catalyst comprises a molecular sieve component, an alumina component, and an inorganic refractory matrix component, whereby said heavy hydrocarbon feedstock is preferentially converted to middle distillate and lower olefins.

Figure 1:
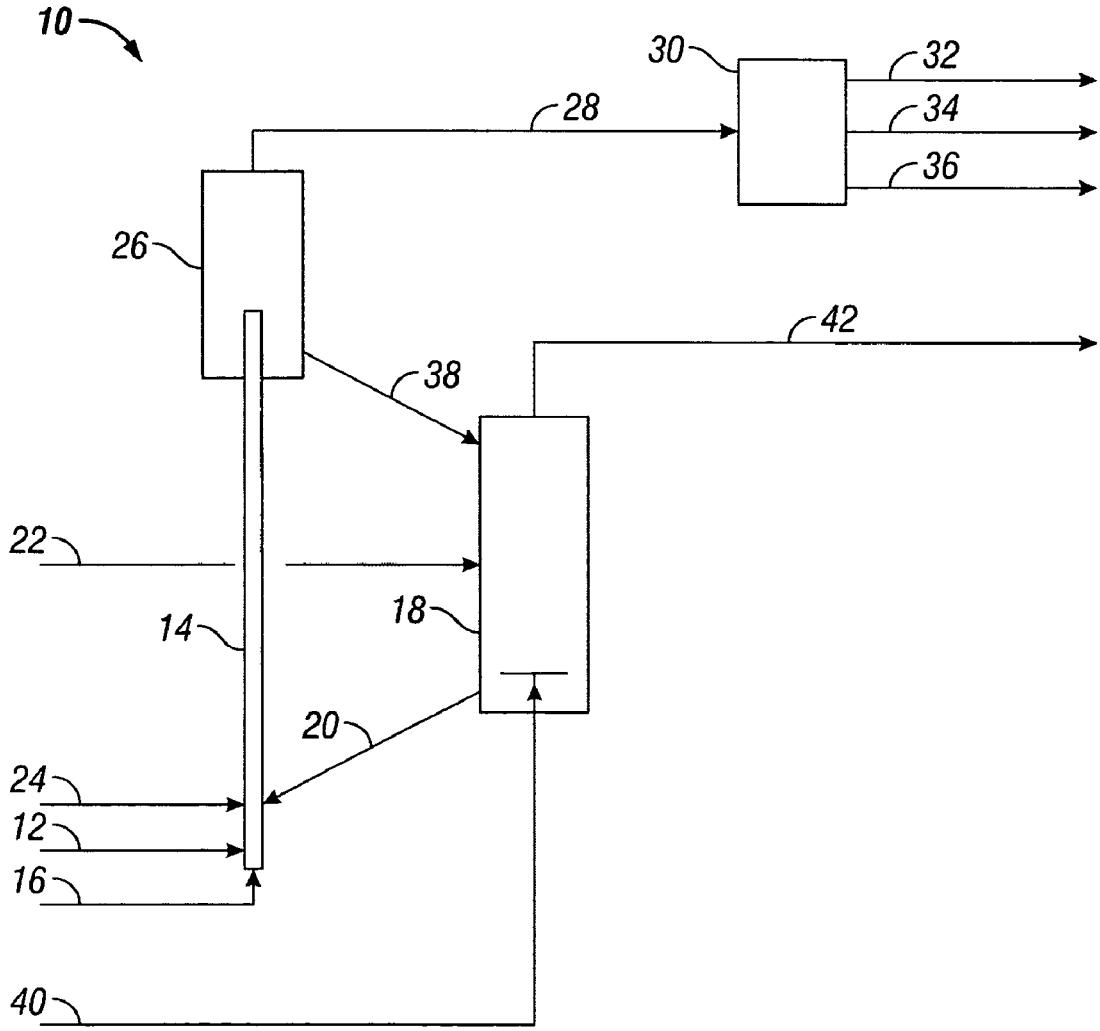
FIG. 1 is a process flow schematic representing certain aspects of the inventive catalytic cracking process that utilizes a middle distillate selective cracking catalyst in combination with a shape selective zeolite additive.

This invention provides for the processing of a heavy hydrocarbon feedstock in a catalytic cracking riser reactor to selectively produce middle distillate boiling range products and lower olefins. It has been discovered that the use of a middle distillate selective cracking catalyst, having a specifically defined composition and properties, in combination with a shape selective zeolite additive in the catalytic cracking of a heavy hydrocarbon feedstock provides for the selective yield of both middle distillate product and lower olefins. The catalytic cracking reaction preferably is conducted within a riser reactor zone defined by a catalytic cracking riser reactor within which the middle distillate selective cracking catalyst and the shape selective zeolite additive are contacted with the heavy hydrocarbon feedstock under suitable catalytic cracking conditions.

The composition of the middle distillate cracking selective cracking catalyst is different from most conventional cracking catalysts that are used in the cracking of heavy hydrocarbons to preferentially yield gasoline. Such conventional cracking catalysts typically comprise large pore zeolites in a matrix. But, in contrast, the middle distillate selective cracking catalyst of the invention comprises zeolite or other molecular sieve component, an alumina component, and an additional porous, inorganic refractory matrix or binder component.

The middle distillate selective cracking catalyst can be prepared by any method known to those skilled in the art that provides for a catalytic cracking catalyst having the desired composition. More specifically, the middle distillate selective cracking catalyst can comprise alumina in the amount in the range of from 40 wt. % to 65 wt. %, preferably from 45 wt. % to 62 wt. %, and most preferably, from 50 wt. % to 58 wt. %, with the weight percent being based on the total weight of the middle distillate selective cracking catalyst, a porous inorganic refractory oxide matrix component providing a matrix surface area, and a zeolite or other molecular sieve component providing a zeolitic surface area. The alumina component of the middle distillate selective cracking catalyst can be any suitable type of alumina and from any suitable source. Examples of suitable types of aluminas are those as disclosed in U.S. Pat. Nos. 5,547,564 and 5,168,086, which are incorporated herein by reference, and include, for example, alpha alumina, gamma alumina, theta alumina, eta alumina, bayerite, pseudoboehmite and gibbsite.

The matrix surface area within the middle distillate selective cracking catalyst that is provided by the porous inorganic refractory oxide matrix component may be in the range of from 20 square meters per gram of middle distillate selective cracking catalyst (20 $m^2/g$) to 90 $m^2/g$. The zeolitic surface area within the middle distillate selective cracking catalyst that is provided by the zeolite or other molecular sieve component should be less than 140 $m^2/g$.

In order for the middle distillate selective cracking catalyst to have the desired catalytic property of preferentially providing for the yield of middle distillate such as diesel, it is particularly important for the portion of the surface area of the middle distillate selective cracking catalyst that is contributed by the zeolite or other molecular sieve component, i.e. the zeolitic surface area, to be less than 130 $m^2/g$, preferably, less than 110 $m^2/g$, and, most preferably, less than 100 $m^2/g$. The preferred zeolite or other molecular sieve component of the middle distillate selective cracking catalyst are those aluminosilicates selected from the group consisting of Y zeolites, ultrastable Y zeolites, X zeolites, zeolite beta, zeolite L, offretite, mordenite, faujasite, and zeolite omega.

The zeolitic surface area within the middle distillate selective cracking catalyst can be as low as 20 $m^2/g$, but, generally, the lower limit is greater than 40 $m^2/g$. Preferably, the lower limit for the zeolitic surface area within the middle distillate selective cracking catalyst exceeds 60 $m^2/g$, and, most preferably, the zeolitic surface area exceeds 80 $m^2$/gm. Thus, for example, the portion of the surface area of the middle distillate selective cracking catalyst contributed by the zeolite or other molecular sieve component, i.e. the zeolitic surface area, can be in the range of from 20 $m^2$/g to 140 $m^2$/g, or in the range of from 40 $m^2$/g to 130 $m^2$/g. A preferred range for the zeolitic surface area is from 60 $m^2$/g to 110 $m^2$/g, and, most preferred, from 80 $m^2$/g to 100 $m^2$/g.

The ratio of the zeolitic surface area to the matrix surface area within the middle distillate cracking catalyst is a property thereof which is important in providing for a catalyst having the desired cracking properties. The ratio of zeolitic surface area to matrix surface area, thus, should be in the range of from 1:1 to 2:1, preferably, from 1.1:1 to 1.9:1, and most preferably, from 1.2:1 to 1.7:1. Considering these ratios, the portion of the surface area of the middle distillate selective cracking catalyst contributed by the porous inorganic refractory oxide matrix component, i.e., the matrix surface area, is generally in the range of from 20 $m^2$/g to 80 $m^2$/g. A preferred range for the matrix surface area is from 40 $m^2$/g to 75 $m^2$/g, and, most preferred, the range is from 60 $m^2$/g to 70 $m^2$/g.

It is an essential aspect of the invention for the middle distillate selective cracking catalyst to be used in combination with a shape selective zeolite additive in the catalytic cracking of the heavy hydrocarbon feedstock. The combined use of the middle distillate selective cracking catalyst, as described above, with the shape selective zeolite additive in the catalytic cracking of a heavy hydrocarbon feedstock selectively provides for both a high yield of middle distillate product and a high yield of lower olefins. The shape selective zeolite additive may include any shape selective zeolite that when used in combination with the middle distillate selective cracking catalyst provides the yield benefits as described herein.

Typically, a suitable shape selective zeolite additive is an additive that includes a shape selective zeolite having a Constraint Index of from 1 to 12. Details of the Constraint Index test are provided in *J. Catalysis,* 67, 218-222 (1981) and in U. S. Pat. No. 4,711,710, both of which are incorporated herein by reference. Suitable shape selective zeolites include those selected from the family of medium pore size crystalline aluminosilicates or zeolites. The medium pore size zeolites generally have a pore size from about 0.5 nm, to about 0.7 nm and include, for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. Medium pore zeolites are described in the "Atlas of Zeolite Structure Types," Eds. W. H. Meier and D. H. Olson, Butterworth-Heineman, Third Edition, 1992, which is hereby incorporated by reference.

ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable molecular sieves include the silicoaluminophosphates (SAPO), such as SAPO-4 and SAPO-11 which is described in U.S. Pat. No. 4,440,871; chromosilicates; gallium silicates, iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The most preferred shape selective zeolite for use in the invention is ZSM-5, which is described in U.S. Pat. Nos. 3,702,886; 3,770,614; and 4,368,114, all of which are incorporated by reference. The ZSM-5 used as the shape selective zeolite additive may be held together with a catalytically inactive inorganic oxide matrix component in accordance with conventional methods.

To provide for the benefits contemplated by the invention, it is important, in addition to the having suitable reaction conditions, to use an appropriate ratio of the shape selective zeolite additive to middle distillate selective cracking catalyst in the contacting with the heavy hydrocarbon feedstock. Generally, the amount of the shape selective zeolite additive relative to the middle distillate selective cracking catalyst introduced into the riser reactor zone of the catalytic cracking riser reactor is in the range upwardly to 30 weight percent, preferably upwardly to 20 weight percent, and, most preferably, upwardly to 18 weight percent, with the weight percent being based upon the total weight of the middle distillate selective cracking catalyst being introduced into the riser reactor zone that is being introduced with the heavy hydrocarbon feedstock.

A minimum level of the shape selective zeolite additive is required to be used in combination with the middle distillate selective cracking catalyst to provide for the improved yield of lower olefins, and the amount of shape selective zeolite additive introduced into the riser along with the middle distillate selective cracking catalyst is, in the typical case, at least 1 weight percent of the total weight of the middle distillate selective cracking catalyst being introduced into the riser reactor zone. It is more desirable to introduce into the riser reactor zone with the middle distillate selective cracking catalyst and the heavy hydrocarbon feedstock an amount of shape selective zeolite additive of at least 2 weight percent of the total weight of the middle distillate selective cracking catalyst introduced into the riser, preferably, the amount is at least 3 weight percent, and, most preferably, at least 5 weight percent.

In view of the above, the amount of shape selective zeolite additive introduced into the riser reactor zone relative to the amount of middle distillate selective cracking catalyst introduced into the riser reactor zone can be in the range of from 1 to 30 weight percent of the middle distillate selective cracking catalyst being introduced into the riser reactor zone, or, preferably, from 2 to 20 weight percent, and, most preferably, from 5 to 18 weight percent.

When referring herein to the combined use of the shape selective zeolite additive with the middle distillate selective cracking catalyst, what is meant is that the shape selective zeolite additive may be separately and independently added to the riser reactor zone of the catalytic cracking riser reactor unit along with the separate and independent addition of the middle distillate selective cracking catalyst, which is in most cases is regenerated catalyst from the catalyst regenerator of the catalytic cracking process unit, or the shape selective zeolite additive may be added to the inventory of cracking catalyst contained in the catalyst regenerator of the catalytic cracking process unit in such amounts as to provide the proportions as detailed above, or the shape selective zeolite additive may be combined with the middle distillate selective cracking catalyst in a manner so as to provide an agglomerate mixture comprising a shape selective zeolite and middle distillate selective cracking catalyst in the proportions as detailed above.

In another embodiment of the invention, the operation and reaction conditions within the riser reactor zone of the catalytic cracking riser reactor can be further controlled by introducing steam along with the heavy hydrocarbon feedstock, the middle distillate selective cracking catalyst, and the shape selective zeolite additive into the riser reactor zone. The use of steam in this manner can provide for even a greater enhancement in the yield of lower olefins such as increasing the yield of propylene and the yield of butylenes. It is a particularly unique feature of this invention that with the steam addition to the riser reactor zone along with middle distillate selective cracking catalyst and the shape selective zeolite additive provide for the greatly improved yields of middle distillate product and lower olefins. To provide for the aforementioned yield benefits, the weight ratio of steam to heavy hydrocarbon feedstock (i.e., steam-to-oil ratio) introduced into the riser reactor zone with the middle distillate selective cracking catalyst and shape selective zeolite additive is such an amount as to be in the range upwardly to 15:1, but, preferably, in the range of from 0.1:1 to 10:1. More preferably, the weight ratio of steam to heavy hydrocarbon feedstock introduced into the riser reactor is in the range of from 0.2:1 to 9:1, and, most preferably, from 0.5:1 to 8:1.

The heavy hydrocarbon feedstock charged to the process of the invention may be any hydrocarbon feedstock that can be or is typically charged to a fluidized catalytic cracking unit. In general terms, hydrocarbon mixtures boiling in the range of from 345° C. (650° F.) to 760° C. (1400° F.) can make suitable feedstocks for the inventive process. Examples of the types of refinery feed streams that can make suitable heavy hydrocarbon feedstocks include vacuum gas oils, coker gas oil, straight-run residues, thermally cracked oils and other hydrocarbon streams.

The middle distillate product of the inventive product is that portion of the cracked hydrocarbon product that boils in the distillate temperature range. The middle distillate product comprises hydrocarbons generally having carbon numbers in the range of from $C_9$ to $C_{28}$. The boiling range of the middle distillate product can be from 150° C. (302° F.) to 390° C. (734° F.). The inventive process provides for a heavy hydrocarbon feedstock conversion in the range of from 30 to 90 weight percent. What is meant by heavy hydrocarbon feedstock conversion is the weight amount of the hydrocarbons contained in the heavy hydrocarbon feedstock that have a boiling temperature greater than 221° C. (430° F.) that is converted in the riser reactor zone to hydrocarbons having a boiling temperature less than 221° C. (430° F.) divided by the weight amount of hydrocarbons contained in the heavy hydrocarbon feedstock having a boiling temperature greater than 221° C. (430° F.). In an embodiment of the inventive hydrocarbon cracking process that provides for a heavy hydrocarbon feedstock conversion in the range of from 70 to 80 weight percent, the middle distillate yield can be in the range of from 14 to 32 weight percent of the heavy hydrocarbon feedstock, the propylene yield can be in the range of from 7.5 to 12.5 weight percent of the heavy hydrocarbon feedstock, and the butylenes yield can be in the range of from 6.5 to 10 weight percent of the heavy hydrocarbon feedstock.

The mixture of heavy hydrocarbon feedstock, middle distillate selective cracking catalyst, shape selective zeolite additive and, optionally, steam, passes through the riser reactor zone wherein cracking takes place. The catalytic cracking riser reactor defines a catalytic cracking zone, or riser reactor zone, and provides means for providing contacting time to allow the cracking reactions to occur. The average residence time of the hydrocarbons within the riser reactor zone generally can be in the range of upwardly to about 5 to 10 seconds, but usually it is in the range of from 0.1 to 5 seconds. The weight ratio of middle distillate selective cracking catalyst to heavy hydrocarbon feedstock (i.e., catalyst-to-oil ratio) introduced into the riser reactor zone generally can be in the range of from about 2 to about 100 and even as high as 150. More typically, the catalyst-to-oil ratio can be in the range of from 5 to 100. When steam is introduced into the riser reactor zone with the heavy hydrocarbon feedstock, the steam-to-oil weight ratio can be in the ranges as described above.

The temperatures in the riser reactor zone generally can be in the range of from about 400° C. (752° F.) to about 600° C. (1112° F.). More typically, the riser reactor zone temperatures can be in the range of from 450° C. (842° F.) to 550° C. (1022° F.). The riser reactor zone temperatures of the inventive process will tend to be lower than those of typical conventional fluidized catalytic cracking processes; because, the inventive process is to provide for a high yield of middle distillates as opposed to the production of gasoline as is often sought with conventional fluidized catalytic cracking processes.

The mixture of cracked heavy hydrocarbons and catalyst from the riser reactor pass as a riser reactor product comprising cracked hydrocarbon product and spent cracking catalyst to a stripper system that provides means for separating hydrocarbons from catalyst and which defines a stripper separation zone wherein the cracked hydrocarbon product is separated from the spent cracking catalyst. The stripper system can be any system or means known to those skilled in the art for separating spent cracking catalyst from cracked hydrocarbon product. In a typical stripper operation, the riser reactor product passes to the stripper system that includes cyclones for separating the spent cracking catalyst from the vaporous cracked hydrocarbon product. The separated spent cracking catalyst enters the stripper vessel from the cyclones where it is contacted with steam to further remove cracked hydrocarbon product from the spent cracking catalyst. The coke content on the separated spent cracking catalyst is, generally, in the range of from about 0.5 to about 5 weight percent (wt. %), based on the total weight of the catalyst and the carbon. Typically, the coke content on the separated spent cracking catalyst is in the range of from or about 0.5 wt. % to or about 1.5 wt. %.

The separated spent cracking catalyst is then passed to a catalyst regenerator that provides means for regenerating the separated spent cracking catalyst and defines a regeneration zone into which the separated spent cracking catalyst is introduced and wherein carbon that is deposited on the separated spent cracking catalyst is burned in order to remove the carbon to provide a regenerated cracking catalyst having a reduced carbon content. The catalyst regenerator typically is a vertical cylindrical vessel that defines the regeneration zone and wherein the spent cracking catalyst is maintained as a fluidized bed by the upward passage of an oxygen-containing regeneration gas, such as air.

The temperature within the regeneration zone is, in general, maintained in the range of from about 621° C. (1150° F.) to 760° C. (1400° F.), and more, typically, in the range of from 677° C. (1250° F.) to 715° C. (1320° F.). The pressure within the regeneration zone typically is in the range of from about atmospheric to about 345 kPa (50 psig), and, preferably, from about 34 to 345 kPa (5 to 50 psig). The residence time of the separated spent cracking catalyst within the regeneration zone is in the range of from about 1 to about 6 minutes, and, typically, from or about 2 to or about 4 minutes. The coke content on the regenerated cracking catalyst is less than the coke content on the separated spent cracking catalyst and, generally, is less than 0.5 wt. %, with the weight percent being based on the weight of the regenerated cracking catalyst excluding the weight of the coke content. The coke content of the regenerated cracking catalyst will, thus, generally, be in the range of from or about 0.01 wt. % to or about 0.5 wt. %. It is preferred for the coke concentration on the regenerated cracking catalyst to be less than 0.3 wt. % and, it will thus preferably be in the range of from 0.01 wt. % to 0.3 wt. %. Most preferably, the coke concentration on the regenerated cracking catalyst is less than 0.1 wt. % and, thus, in the range of from 0.01 wt. % To 0.1 wt. %.

The regenerated catalyst settles within the catalyst regenerator from which inventory is withdrawn the regenerated catalyst for use as the middle distillate selective cracking catalyst that is introduced into the riser reactor zone of the inventive process. Fresh or unused middle distillate selective cracking catalyst may be added to the inventory of regenerated catalyst contained within the catalyst regenerator to also be used as the middle distillate selective cracking catalyst of the inventive process.

FIG.1 presents a process flow schematic representative of a catalytic cracking process system 10 that utilizes a middle distillate selective cracking catalyst in combination with a shape selective zeolite additive and with the optional use of steam. In the catalytic process system 10, a heavy hydrocarbon feedstock passes through conduit 12 and is introduced into the bottom of riser reactor 14. Riser reactor 14 defines a riser reactor zone, or a cracking zone, wherein the heavy hydrocarbon feedstock is mixed and contacted with the middle distillate selective cracking catalyst, the shape selective zeolite additive, and, optionally, but preferably, steam. The riser reactor zone defined by the riser reactor 14 is operated under such suitable cracking conditions so as to selectively yield middle distillate and light olefins products. The steam is introduced into the bottom of the riser reactor 14 by way of conduit 16.

In the preferred embodiment of the invention, the middle distillate selective cracking catalyst that is introduced into the riser reactor 14 is a regenerated catalyst taken from catalyst regenerator 18 and which passes through conduit 20 to be introduced into the bottom of riser reactor 14 for contacting with the heavy hydrocarbon feedstock that is introduced by way of conduit 12. The shape selective zeolite additive is, in combination with the middle distillate selective cracking catalyst, also contacted with the heavy hydrocarbon feedstock within the riser reactor 14.

There are several suitable approaches depicted in FIG. 1 to combining the use of the shape selective zeolite additive with the middle distillate selective cracking catalyst. In addition to the mixing of the shape selective zeolite additive with the middle distillate selective cracking catalyst to form a single agglomerate mixture of the two components that can be contacted with the heavy hydrocarbon feedstock, another alternative method is for the shape selective zeolite additive to be added to the inventory of middle distillate selective cracking catalyst contained in the catalyst regenerator 18 by way of conduit 22. Another method of using the shape selective cracking catalyst in combination with the middle distillate selective cracking catalyst is to separately introduce the shape selective cracking catalyst into the bottom of riser reactor 14 by way of conduit 24.

The mixture of heavy hydrocarbon feedstock, middle distillate selective cracking catalyst, shape selective zeolite additive, and, optionally, steam, passes through riser reactor 14 and is introduced into stripper system or separator/stripper 26.

The separator/stripper 26 can be any conventional system that defines a separation zone or stripping zone, or both, and provides means for separating the cracked hydrocarbon product and spent cracking catalyst. The separated cracked hydrocarbon product passes from separator/stripper 26 by way of conduit 28 to separation system 30. The separation system 30 can be any system known to those skilled in the art for recovering and separating the cracked hydrocarbon product into the various catalytically cracked products, such as, for example, cracked gas, cracked gasoline, cracked middle distillate and cycle oil. The separation system 30 may include such systems as absorbers and strippers, fractionators, compressors and separators or any combination of known systems for providing recovery and separation of the products that make up the cracked hydrocarbon product.

The separation system 30, thus, defines a separation zone and provides means for separating the cracked hydrocarbon product into cracked products. The cracked gas, which can comprise lower olefins, cracked gasoline and cracked middle distillate respectively pass from separation system 30 through conduits 32, 34, and 36.

The separated spent cracking catalyst passes from separator/stripper 26 through conduit 38 and is introduced into catalyst regenerator 18. Catalyst regenerator 18 defines a regeneration zone and provides means for contacting the spent cracking catalyst with an oxygen-containing gas, such as air, under carbon burning conditions to remove carbon from the spent cracking catalyst. The oxygen-containing gas is introduced into catalyst regenerator 18 through conduit 40 and the combustion gases pass from catalyst regenerator 18 by way of conduit 42.

The following examples are provided to further illustrate the invention, but, otherwise, they are not to be limiting.

EXAMPLE I

This Example I demonstrates the yield benefits that result from the use of a ZSM-5 additive in combination with a middle distillate selective cracking catalyst in the catalytic cracking of a hydrocarbon feedstock within an intermediate cracking reactor system.

An experimental pilot system was used to conduct the experiments. The pilot system consisted of six sections including a feed supply system, a catalyst loading and transfer system, a riser reactor, a stripper, a product separation and collecting system, and a regenerator. The riser reactor was an adiabatic riser having an inner diameter of from 11 mm to 19 mm and a length of about 3.2 m. The riser reactor outlet was in fluid communication with the stripper that was operated at the same temperature as the riser reactor outlet flow and in a manner so as to provide essentially 100 percent stripping efficiency. The regenerator was a multi-stage continuous regenerator used for regenerating the spent catalyst. The spent catalyst was fed to the regenerator at a controlled rate and the regenerated catalyst was collected in a vessel. Material balances were obtained during each of the experimental runs at 30-minute intervals. Composite gas samples were analyzed by use of an on-line gas chromatograph and the liquid product samples were collected and analyzed overnight. The coke yield was measured by measuring the catalyst flow and by measuring the delta coke on the catalyst as determined by measuring the coke on the spent and regenerated catalyst samples taken for each run when the unit was operating at steady state.

FIGS. 2, 3, 4, and 5 present a summary of the data obtained from conducting the cracking experiments in the aforedescribed experimental pilot system. In these cracking experiments a middle distillate (or diesel) selective cracking catalyst was used in cracking a hydrocarbon feedstock. The comparisons presented in these Figs. are for a process operation in which the middle distillate selective cracking catalyst was used without any addition of a ZSM-5 additive and for a process operation in which the middle distillate selective cracking catalyst was used with the addition of ten percent ZSM-5 additive.

Figure 2:
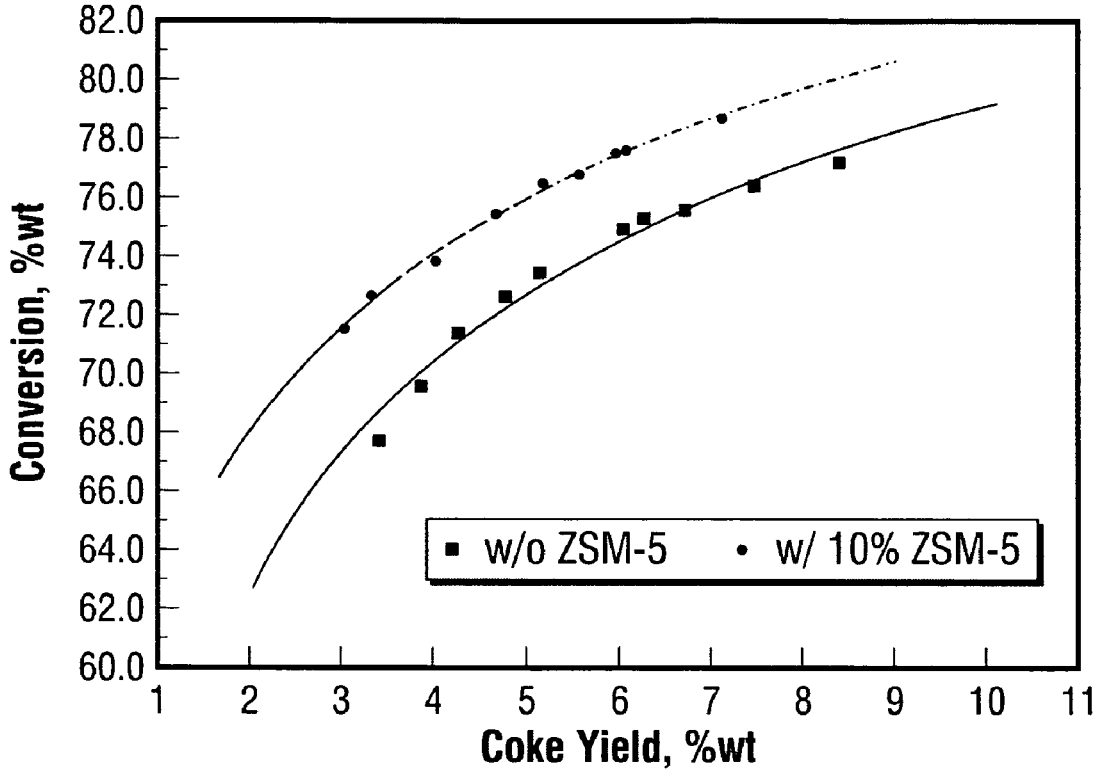
FIG. 2 presents comparison plots showing the coke selectivity (wt. % coke yield versus wt. % feed conversion) resulting from the use of a middle distillate selective cracking catalyst without the addition of ZSM-5 as compared to the use of the middle distillate selective cracking catalyst with the addition of 10 wt. % ZSM-5.

As may be seen from FIG. 2, the process that utilizes the ZSM-5 additive in combination with the middle distillate selective cracking catalyst provides for a better coke selectivity than does the process that utilizes the middle distillate selective cracking catalyst alone without the ZSM-5 additive. Thus, for a given coke yield, the combined use of the middle distillate selective cracking catalyst with the ZSM-5 additive provides a higher percentage conversion of the hydrocarbon feedstock than does the use of the middle distillate selective cracking catalyst alone. Or, in the alternative, for a given hydrocarbon feedstock conversion, the combined use of the middle distillate selective cracking catalyst with the ZSM-5 additive provides for a lower coke yield than does the use of the middle distillate selective cracking catalyst alone.

Figure 3:
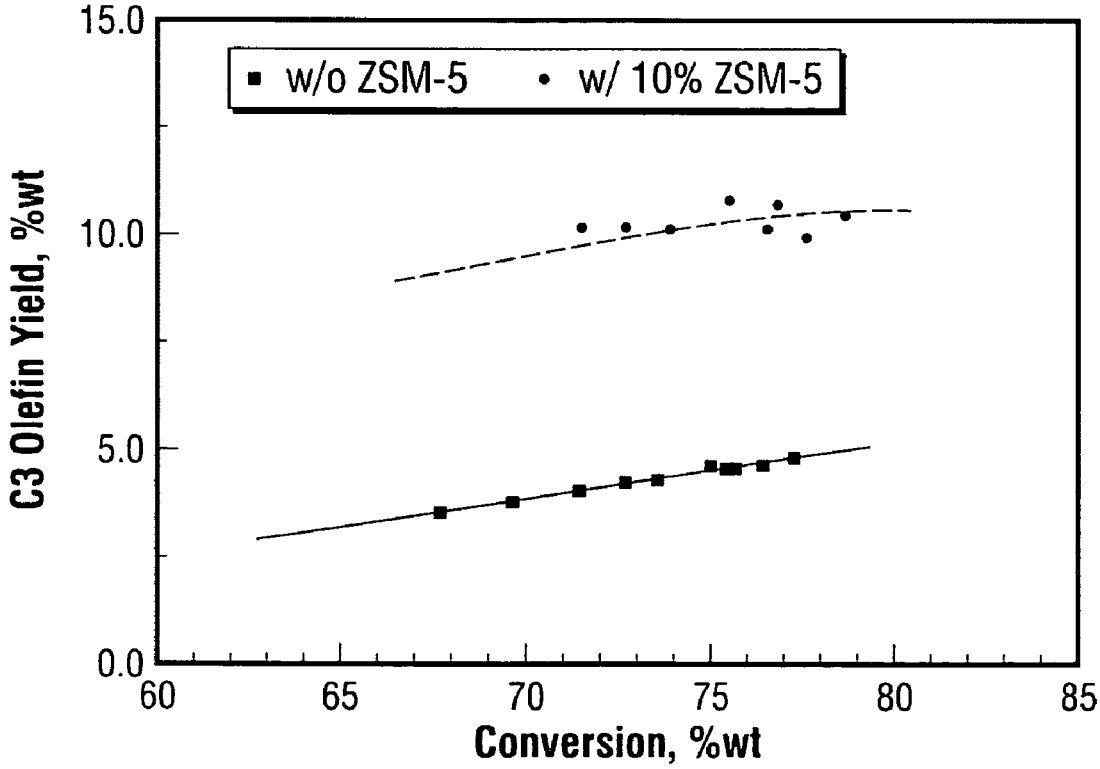
FIG. 3 presents comparison plots showing the propylene yield versus feed conversion resulting from the use of a middle distillate selective cracking catalyst without the addition of ZSM-5 as compared to the use of the middle distillate selective cracking catalyst with the addition of 10 wt. % ZSM-5.
Figure 4:
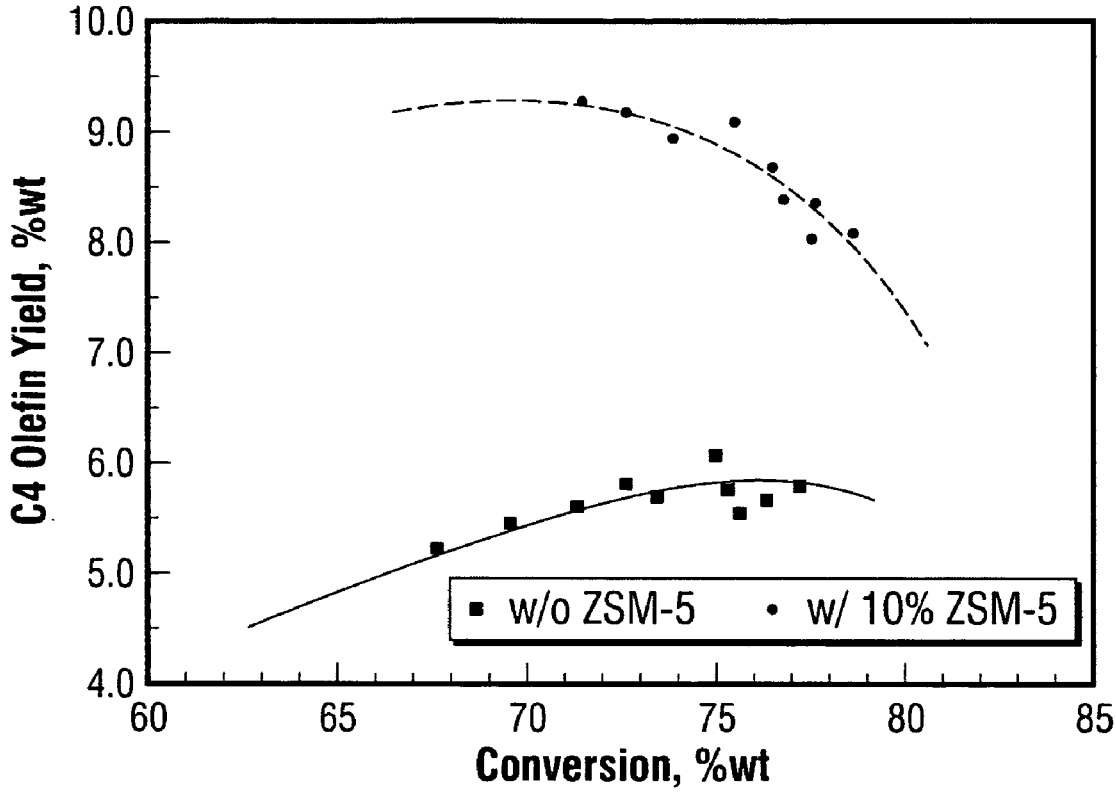
FIG. 4 presents comparison plots showing the butylenes yield versus feed conversion resulting from the use of a middle distillate selective cracking catalyst without the addition of ZSM-5 as compared to the use of the middle distillate selective cracking catalyst with the addition of 10 wt. % ZSM-5.

The summary of data presented in FIG. 3 and FIG. 4 demonstrates the huge improvement in lower olefin yield that results from the combined use of the middle distillate selective cracking catalyst with the ZSM-5 additive in the cracking of a hydrocarbon feedstock. As is shown in both these Figs., for a given hydrocarbon feedstock conversion, the combined use of the middle distillate selective cracking catalyst with the ZSM-5 additive provides for a significantly greater yield of both propylene and butylenes than does the use of the middle distillate selective cracking catalyst alone.

Figure 5:
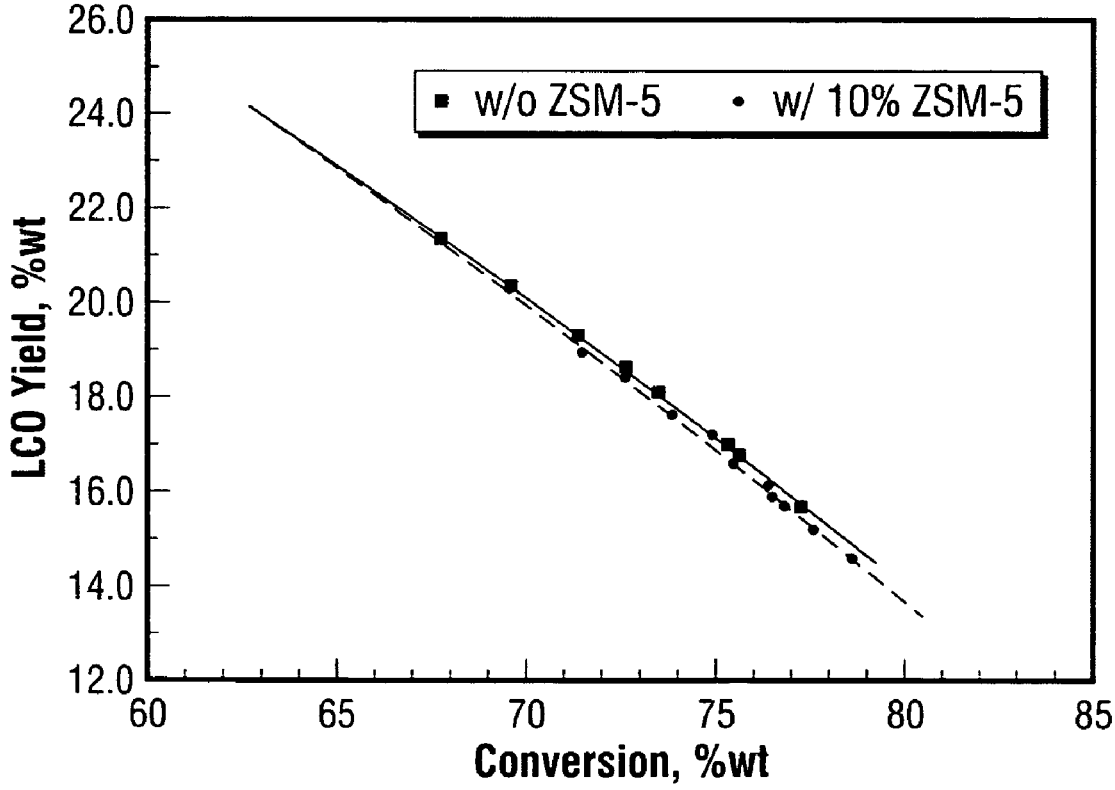
FIG. 5 presents comparison plots showing the light cycle oil yield versus feed conversion resulting from the use of a middle distillate selective cracking catalyst without the addition of ZSM-5 versus the use of the middle distillate selective cracking catalyst with the addition of 10 wt. % ZSM-5.

The summary of data presented in FIG. 5 shows that for a given hydrocarbon feedstock conversion, the combined use of the middle distillate selective cracking catalyst with the ZSM-5 additive has little impact on the yield of light cycle oil as compared to the use of the middle distillate selective cracking catalyst alone. Thus, when it is desired to crack a hydrocarbon feedstock to manufacture a middle distillate product, instead of a gasoline product, and lower olefins, the combined use of a middle distillate selective cracking catalyst with the ZSM-5 additive in an intermediate cracking reactor can provide significant advantages of the use of the middle distillate cracking catalyst alone.

EXAMPLE II

This Example II demonstrates the yield benefits resulting from the use of steam in the catalytic cracking of a hydrocarbon feedstock in an intermediate cracking reactor system utilizing a middle distillate selective cracking catalyst in combination with a ZSM-5 additive. FIGS. 6, 7, 8, and 9 present a summary of the data obtained from conducting the cracking experiments in the same experimental pilot system describe in the above Example I. In these cracking experiments, a middle distillate (or diesel) selective cracking catalyst was used in combination with a ZSM-5 additive in the cracking a hydrocarbon feedstock. The comparisons presented in these Figs. are for a process operation in which steam was introduced along with the hydrocarbon feedstock and for a process operation in which no steam was introduced along with the hydrocarbon feedstock.

Figure 6:
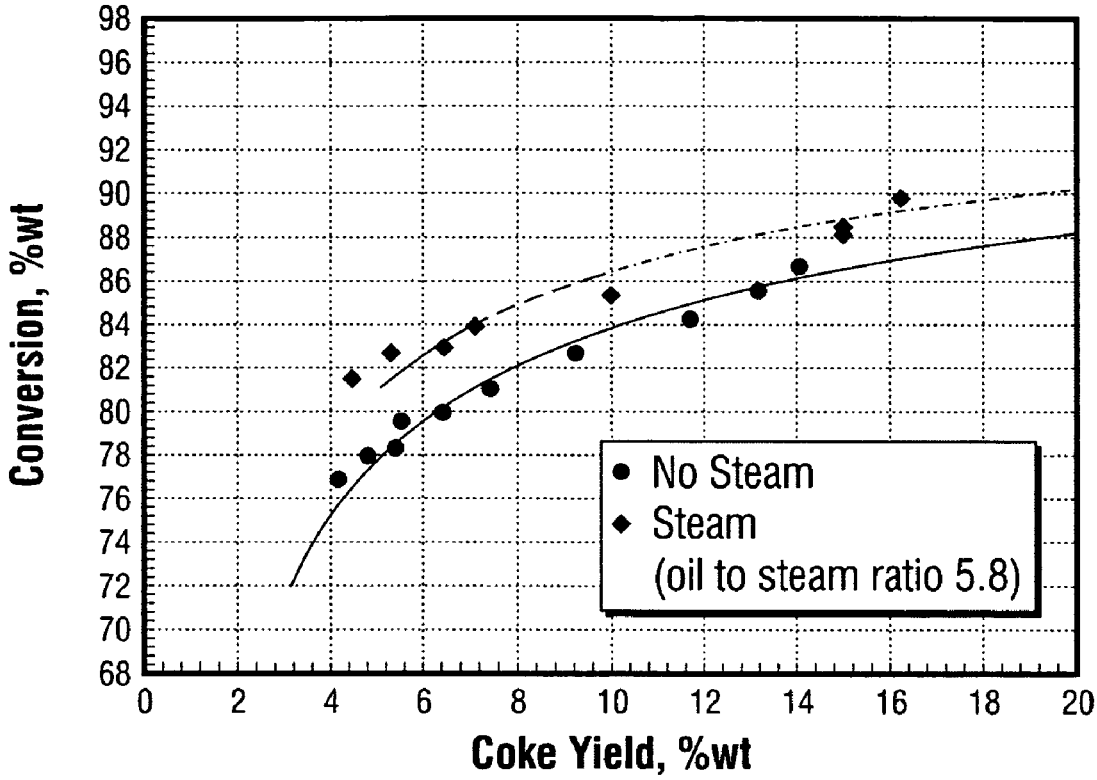
FIG. 6 presents comparison plots showing the coke selectivity resulting from the use of steam with a middle distillate selective cracking catalyst with the addition of 10 wt. % ZSM-5 as compared to the use of no steam with the same middle distillate selective cracking catalyst with the addition of 10 wt. % ZSM-5.

As may be seen from FIG. 6, the process that utilizes steam provides for a better coke selectivity than the process that does not use steam. Thus, for a given coke yield, the use of steam in a cracking process that uses in combination a middle distillate selective cracking catalyst with a ZSM-5 additive provides a higher percentage conversion of the hydrocarbon feedstock than does such a process that does not use steam. Or, in the alternative, for a given hydrocarbon feedstock conversion, the addition of steam with the hydrocarbon feedstock to a cracking process that uses in combination of a middle distillate selective cracking catalyst with the ZSM-5 additive provides for a lower coke yield than does such a process that does not use steam.

Figure 7:
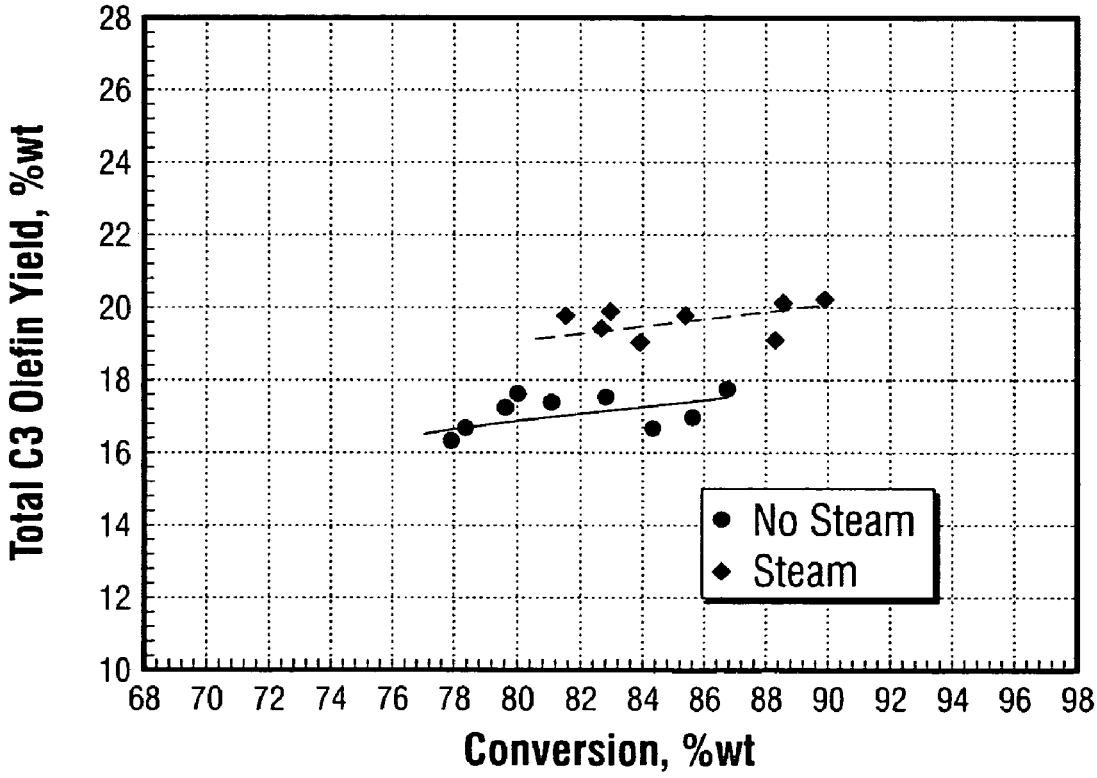
FIG. 7 presents comparison plots showing propylene yield versus feed conversion resulting from the use of steam with a middle distillate selective cracking catalyst with the addition of 10 wt. % ZSM-5 as compared to the use of no steam with the same middle distillate selective cracking catalyst with the addition of 10 wt. % ZSM-5.
Figure 9:
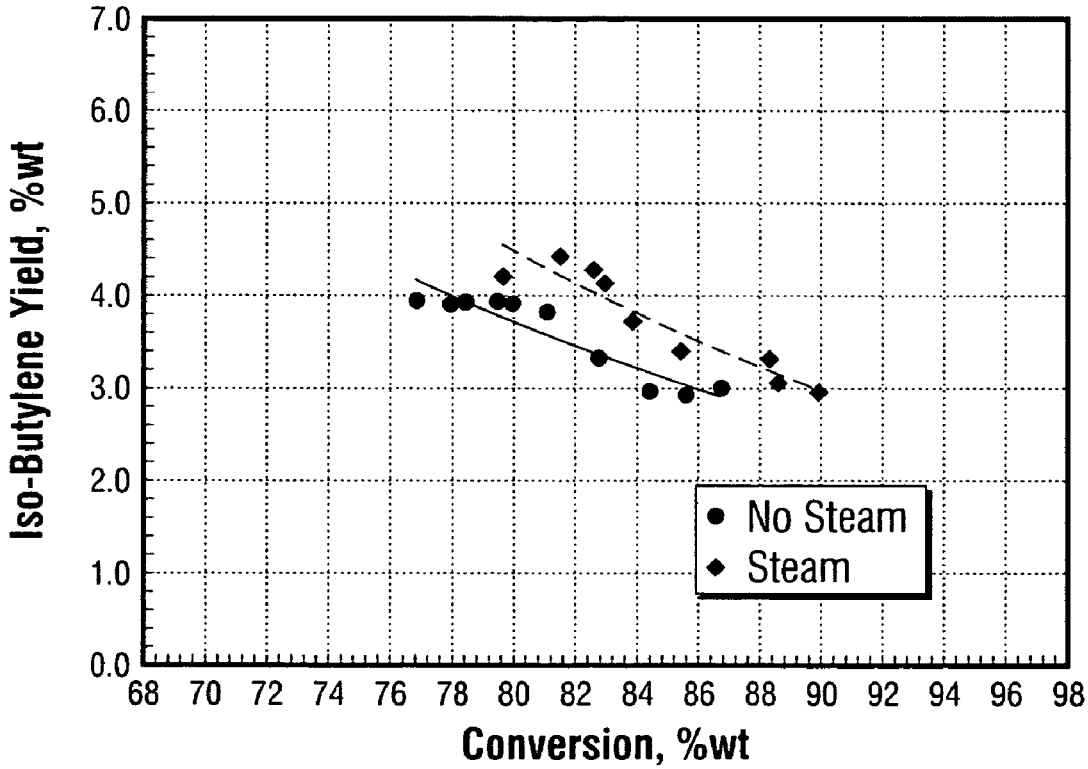
FIG. 9 presents comparison plots showing isobutylene yield versus feed conversion resulting from the use of steam with a middle distillate selective cracking catalyst with the addition of 10 wt. % ZSM-5 as compared to the use of no steam with the same middle distillate selective cracking catalyst with the addition of 10 wt. % ZSM-5.

The summary of data presented in FIG. 7 and FIG. 9 demonstrates the huge improvement in lower olefin yield that results from the use of steam in the cracking of a hydrocarbon feedstock in a process that uses a middle distillate selective cracking catalyst in combination with the ZSM-5 additive. As is shown in both these Figs., for a given hydrocarbon feedstock conversion, the use of steam provides for a significantly greater yield of both propylene and butylenes than does the process that does not use steam.

Figure 8:
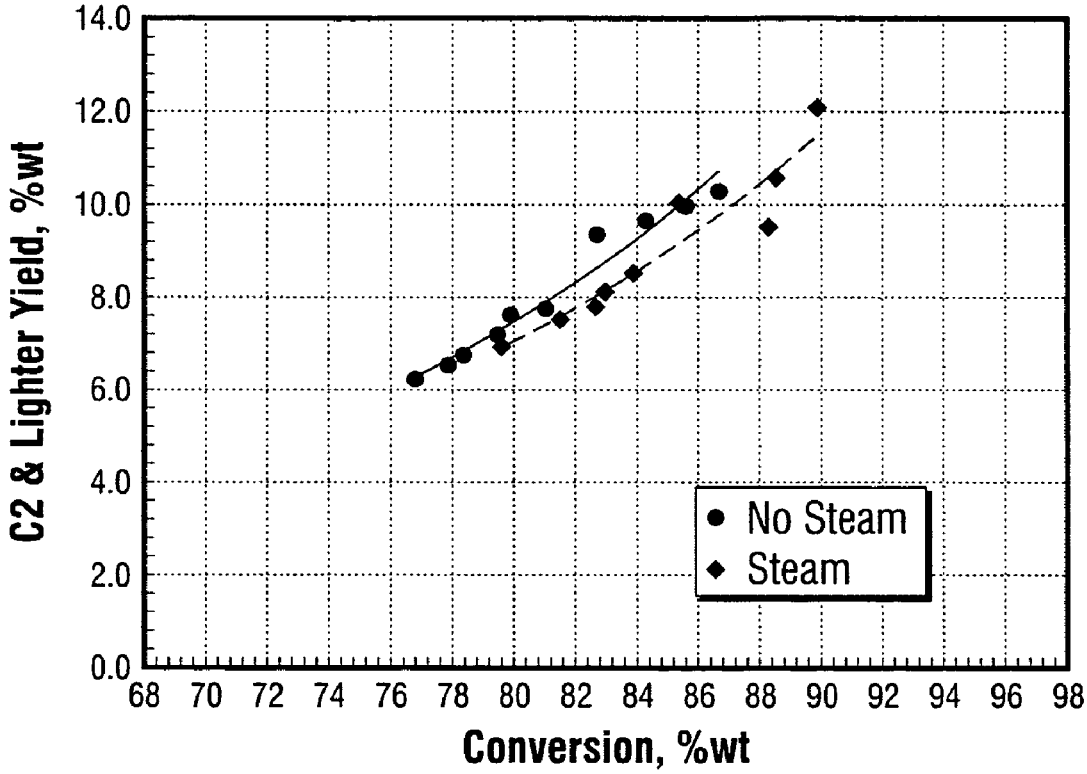
FIG. 8 presents comparison plots showing dry gas yield versus feed conversion resulting from the use of steam with a middle distillate selective cracking catalyst with the addition of 10 wt. % ZSM-5 as compared to the use of no steam with the same middle distillate selective cracking catalyst with the addition of 10 wt. % ZSM-5.

The summary of data presented in FIG. 8 shows that for a given hydrocarbon feedstock conversion, the addition of steam to the hydrocarbon feedstock in a process that uses a middle distillate selective cracking catalyst in combination with the ZSM-5 additive provides for a reduction in the yield of dry gases such as ethane and lighter compounds as compared to the process that does not use steam.

That which is claimed is:

1. A hydrocarbon cracking process for converting a heavy hydrocarbon feedstock preferentially to middle distillate and lower olefins, wherein said hydrocarbon cracking process comprises:

catalytically cracking said heavy hydrocarbon feedstock within a riser reactor zone by contacting under suitable catalytic cracking conditions within said riser reactor zone said heavy hydrocarbon feedstock with a middle distillate selective cracking catalyst in combination with a shape selective zeolite additive that are introduced into said riser reactor zone, wherein said middle distillate selective cracking catalyst comprises a molecular sieve component, an alumina component, and an inorganic refractory matrix component, wherein said middle distillate selective cracking catalyst comprises a zeolitic surface area less than 130 $m^2/g$, whereby said heavy hydrocarbon feedstock is preferentially converted to middle distillate and lower olefins.

2. A hydrocarbon cracking process as recited in claim 1, wherein said alumina component of said middle distillate selective cracking catalyst is present therein in an amount in the range of from 40 wt. % to 65 wt. %, with the weight percent being based upon the total weight of the middle distillate selective cracking catalyst.

3. A hydrocarbon cracking process as recited in claim 2, wherein said molecular sieve component of said middle distillate selective cracking catalyst provides a total zeolitic surface area within said middle distillate selective cracking catalyst of less than 110 $m^2/g$, and wherein said inorganic refractory matrix component of said middle distillate selective catalyst provides a total matrix surface area within said middle distillate selective cracking catalyst in the range of from 20 $m^2/g$ to 90 $m^2/g$.

4. A hydrocarbon cracking process as recited in claim 3, wherein the ratio of total zeolitic surface area to total matrix surface area is in the range of from 1:1 to 2:1.

5. A hydrocarbon cracking process as recited in claim 4, wherein the weight ratio of said middle distillate selective cracking catalyst to said heavy hydrocarbon feedstock introduced into said riser reactor zone is in the range of from 0.1:1 to 20:1.

6. A hydrocarbon cracking process as recited in claim 5, wherein the amount of said shape selective zeolite additive introduced into said riser reactor zone is in the range upwardly to 30 weight percent of said middle distillate selective cracking catalyst introduced into said riser reactor zone.

7. A hydrocarbon cracking process as recited in claim 6, further comprising: introducing steam into said riser reactor zone in an amount such that the weight ratio of steam introduced into said riser reactor zone to said heavy hydrocarbon feedstock introduced into said riser reactor zone is in the range of upwardly to 15:1.

* * * * *